United States Patent [19]

Tsuge et al.

[11] Patent Number: 4,552,472

[45] Date of Patent: Nov. 12, 1985

[54] INK DOT PRINTER

[75] Inventors: Takeyoshi Tsuge; Yoshiro Torisawa; Ayumu Makino, all of Mishima, Japan; Tsutomu Kimura, deceased, late of Mishima, Japan, by Shizuko Kimura, legal representative

[73] Assignee: Tokyo Electric Co., Ltd., Tokyo, Japan

[21] Appl. No.: 617,361

[22] Filed: Jun. 5, 1984

[30] Foreign Application Priority Data

| | | | |
|---|---|---|---|
| Jun. 10, 1983 | [JP] | Japan | 58-103958 |
| Oct. 17, 1983 | [JP] | Japan | 58-193825 |
| Oct. 24, 1983 | [JP] | Japan | 58-199450 |
| Oct. 31, 1983 | [JP] | Japan | 58-205619 |
| Nov. 4, 1983 | [JP] | Japan | 58-207161 |
| Nov. 15, 1983 | [JP] | Japan | 58-214407 |

[51] Int. Cl.[4] ..... B41J 3/12; B41J 27/18

[52] U.S. Cl. ..... 400/124; 400/470; 101/93.05

[58] Field of Search ..... 400/124, 470–471.1; 101/93.05

[56] References Cited

U.S. PATENT DOCUMENTS

| | | | |
|---|---|---|---|
| 4,194,846 | 3/1980 | Zerillo | 400/124 |
| 4,279,519 | 7/1981 | Shiurila | 400/124 |
| 4,353,654 | 10/1982 | Shiurila . | |
| 4,400,102 | 8/1983 | Shiurila et al. | 400/124 |

FOREIGN PATENT DOCUMENTS

| | | | |
|---|---|---|---|
| 2546835 | 4/1977 | Fed. Rep. of Germany | 400/124 |
| 56-95682 | 8/1982 | Japan | 400/124 |

OTHER PUBLICATIONS

IBM Technical Disclosure Bulletin, vol. 18, No. 9, Feb. 1976, p. 2761, Armond, U.S., D. P. Darwin et al.: "Magnetic Method of Inking Print Wires".

*Primary Examiner*—Paul T. Sewell

*Attorney, Agent, or Firm*—Frishauf, Holtz, Goodman & Woodward

[57] ABSTRACT

An ink dot printer includes an ink tank having a magnetic ink supplying hole and an air opening; a pair of magnetic pole plates arranged to form a slit one end of which is immersed in magnetic ink in the ink tank; and an electromagnet for magnetizing the magnetic pole plates to introduce the magnetic ink in the ink tank into the slot to form a magnetic ink film. A plurality of needles arranged adjacent to one another along the longitudinal direction of the slit are each freely movable in its longitudinal direction between a first position where one end portion is immersed in the magnetic ink film in the slit, and a second position where the one end portion is projected from the magnetic ink film. Electromagnets selectively drive the needles to move them from the first position to the second position, wherein the needles selected force the magnetic ink adhered on their one ends at the first position, onto a recording paper to form dots of the magnetic ink. Characters thus are printed by groupings of the dots; and a magnet is provided for returning ink which remains in the slit to the ink tank when the pole plates are not in a magnetized state.

22 Claims, 21 Drawing Figures

INK DOT PRINTER

BACKGROUND OF THE INVENTION

The present invention relates to an ink dot printer comprising magnetic ink storing means provided with a magnetic ink supplying hole and an air opening; a pair of magnetic pole plates arranged opposite to each other to form a slit having one end portion immersed in magnetic ink supplied from the magnetic ink storing means; and magnetism generating means for magnetizing the paired magnetic pole plates to introduce the magnetic ink from the magnetic ink storing means to the slit so as to form a magnetic ink film in the slit. A plurality of needles are arranged adjacent to one another along the longitudinal direction of the slit, each freely movable in its longitudinal direction between a first position where one end portion is immersed in the magnetic ink film in the slit, and a second position where its one end portion projected from the magnetic ink film. Driving means selectively drives the needles to move them from the first position to the second position; wherein the single or plural needles selected force the magnetic ink, adhered on the one end portions at the first position, onto a recording paper to form dots of the magnetic ink, and wherein symbols, such as characters and numerals, are printed by the dots.

Thermal or wire dot printers are usually used as an ink dot printer. In the case of the wire dot printer, plural needles are selectively driven to directly strike a pressure-sensitive manifold paper on a platen with their end faces, or indirectly strike a recording paper with their end faces through a printing ribbon interposed between the paper and needles so as to form dots, thereby enabling symbols, such as characters and numerals, to be printed by grouping of the dots. With the conventional wire dot printer having the above-described arrangement, however, a loud noise is generated at the time of printing symbols on the pressure-sensitive manifold paper. In addition, no paper except the pressure-sensitive manifold type can be used, and the expensive printing ribbon must frequently be replaced by a new one. The expensive printing ribbon also must be used in the thermal dot printers.

In order to eliminate the drawbacks of the conventional thermal or wire dot printers, there have been proposed various kinds of ink dot printers wherein one end portion of each of plural needles is arranged in a slit formed by a pair of magnetic pole plates, the paired magnetic pole plates are magnetized to draw magnetic ink supplied from the magnetic ink storing means into the slit and adhere the magnetic ink onto the one end portions of the plural needles, and the plural needles are then selectively driven to transfer the magnetic ink on their end faces onto the recording paper on the platen so as to form dots. With the ink dot printer of this type, however, the process of supplying the liquid magnetic ink to the magnetic ink storing means is troublesome, and it often happens that the magnetic ink is caused to overflow from the magnetic ink supplying hole of the magnetic ink storing means in the course of the supplying process, or that the magnetic ink is caused to splash over the magnetic ink storing means before it reaches the magnetic ink supplying hole.

Further, that liquid magnetic ink whose viscosity has increased because it has been exposed to air in the slit for a relatively long time, when the paired magnetic pole plates are de-energized during non-use, cannot be quickly collected into the magnetic ink storing means and part of it remains in the slit due to its surface tension and dries. The dried magnetic ink thus stuck in the slit is likely to prevent the liquid magnetic ink from being drawn from the magnetic ink storing means into the slit and also prevent the operation of the needles, whose one end portions are arranged in the slit, when the ink dot printer is used again.

Furthermore, when the ink dot printer is suddenly moved or a carriage on which the paired magnetic pole plates, magnetism generating means, plural needles, driving means, and magnetic ink storing means are mounted is suddenly moved to form dots along the longitudinal center line of the platen, the magnetic ink swells in the magnetic ink storing means and sometimes jets outside through the air opening of the magnetic ink storing means.

Still furthermore, when the ink dot printer is left unused for a long time, the magnetic ink in the magnetic ink storing means dries at its surface area where it contacts air and sticks to the inner wall of the magnetic ink storing means. The dried magnetic ink thus stuck to the inner wall of the magnetic ink storing means, must be removed by detaching the magnetic ink storing means from the ink dot printer and washing it. In the case of the conventional ink dot printer, however, the longitudinal direction of the slit is substantially vertical, and the paired magnetic pole plates are inserted into and connected with the magnetic ink storing means in the longitudinal direction of the slit. Therefore, the process of releasing the connection between the paired magnetic pole plates and the magnetic ink storing means to detach the magnetic ink storing means from the ink dot printer becomes troublesome.

SUMMARY OF THE INVENTION

The present invention is therefore intended to eliminate the above-mentioned drawbacks. A first object of the present invention is to provide an ink dot printer capable of easily supplying magnetic ink to magnetic ink storing means but without overfilling it, through a magnetic ink supplying hole of said magnetic ink storing means and also without splashing it over the magnetic ink storing means before it reaches the magnetic ink supplying hole, in the course of supplying the ink to the magnetic ink storing means.

The first object of the present invention is achieved by an ink dot printer comprising magnetic ink storing means provided with a magnetic ink supplying hole and an air opening; a pair of magnetic pole plates arranged opposite to each other to form a slit having one end immersed in magnetic ink supplied from the magnetic ink storing means; magnetism generating means for magnetizing the pair of the magnetic pole plates in order to introduce the magnetic ink supplied from the magnetic ink storing means to the slit so as to form a magnetic ink film in the slit. A plurality of needles are arranged adjacent to one another along the longitudinal direction of the slit and each freely movable in its longitudinal direction between a first position where one end portion is immersed in the magnetic ink film in the slit formed by the paired magnetic pole plates and a second position where one end portion is projected from the magnetic ink film. Driving means selectively drives the needles to move them from the first position to the second position, wherein one or plural needles selected force the magnetic ink, which has adhered on the end portions at the first position, onto a recording paper to form dots of the magnetic ink and wherein symbols, such as characters and numerals, are printed by grouping of the dots; and an ink cartridge is freely detachable from the magnetic ink supplying hole of the magnetic ink storing means.

In the case of an ink dot printer having such arrangement as described above, it is preferable that the ink cartridge be located in a direction which intersects the direction in which the needles are moved between the first and the second position.

When the ink cartridge is thus arranged, the whole length of the ink dot printer can be shortened in the direction in which the needles are moved, and the whole width thereof can be shortened in a direction perpendicular to the direction in which the needles are moved.

It is also preferable that the inner end face of the magnetic ink supplying hole be located inside the inner end face of the air opening in the magnetic ink storing means. If so, the magnetic ink is not caused to jet outside through the air opening even when it swells in the magnetic ink storing means during the movement of the ink dot printer or carriage (on which the paired magnetic pole plates, magnetic generating means, plural needles, driving means, and magnetic ink storing means are mounted) on a line along the longitudinal center line of a platen.

A second object of the present invention is to provide an ink dot printer capable of smoothly drawing the magnetic ink from the magnetic ink storing means into the slit and also smoothly operating the needles whose one end portions are arranged in the slit, but without causing the magnetic ink to be dried and stuck to the slit even at the time of re-use of the ink dot printer after a period of non-use.

The second object of the present invention can be achieved by a magnetic ink storing means having a magnet arranged opposite to the slit between the paired magnetic pole plates in the longitudinal direction of the slit.

In the case of such ink dot printer, magnetic force, generated in the slit between the paired magnetic pole plates by means of the magnetic generating means, must be set larger than magnetic force generated by the magnet. It may be arranged that the magnet is an electromagnet and that magnetic force is generated by the electromagnet for a certain time just after the excitation of the paired magnetic pole plates by the magnetic generating means, is stopped. If so, the magnetic ink in the slit is forcedly drawn into the magnetic ink storing means due to magnetic force generated by the electromagnet, thus leaving no remaining magnetic ink in the slit when excitation of the paired magnetic pole plates by the magnetic generating means is stopped at the time of non-use of the ink dot printer. This holds true even in a case where viscosity of the magnetic ink in the slit has increased because it has been exposed to air in the slit for a relatively long time.

A third object of the present invention is to provide an ink dot printer capable of preventing the magnetic ink from swelling inside the magnetic ink storing means and jetting outside the magnetic ink storing means through its air opening, even when the ink dot printer is suddenly moved or the carriage (on which the paired magnetic pole plates, magnetic generating means, plural needles, driving means and magnetic ink storing means are mounted) is suddenly moved on a line along the longitudinal center line of the platen.

The third object of the present invention can be attained by magnetic ink storing means, provided with wave eliminating means for preventing the magnetic ink from swelling in the magnetic ink storing means.

It is preferable in the case of such ink dot printer that the wave eliminating means not be located just under the magnetic ink supplying hole. When the wave eliminating means is thus located, the magnetic ink can be supplied very smoothly from the ink cartridge to the magnetic ink storing means through the magnetic ink supplying hole.

The wave eliminating means can be formed by arranging a plurality of fiber-like wires inside the magnetic ink storing means, arranging a net inside the magnetic ink storing means, or arranging a partition plate inside the magnetic ink storing means, said partition plate extending in a direction perpendicular to the longitudinal direction of the magnetic ink storing means and having a through-hole therein.

It is preferable that the wave eliminating net means be thinner in density at its area adjacent to the paired magnetic pole plates than at its other area. If so, the magnetic ink, which has formed a magnetic ink film in the slit, can be quickly collected into an ink tank by stopping the magnetic flux generated between the paired magnetic pole plates, even when the wave eliminating means is arranged inside the ink tank.

The wave eliminating net means can be shaped like a basket. This basket-like wave eliminating means can be easily arranged inside the magnetic ink storing means.

A fourth object of the present invention is to provide an ink dot printer wherein the magnetic ink storing means can be easily detached from the paired magnetic pole plates.

The fourth object of the present invention can be attained by the paired magnetic pole plates being detachably inserted in a direction perpendicular to the longitudinal direction of the slit, and the magnetic ink storing means be provided with a guide hole for guiding the magnetic ink storing means to a predetermined position relative to the paired magnetic pole plates.

It is particularly preferable, in this case, that the magnetic ink storing means has a wave eliminating means arranged therein to prevent the magnetic ink from swelling in the magnetic ink storing means during the process of detaching the magnetic ink storing means from the paired magnetic pole plates.

DESCRIPTION OF THE PREFERRED EMBODIMENTS

Figure 1:
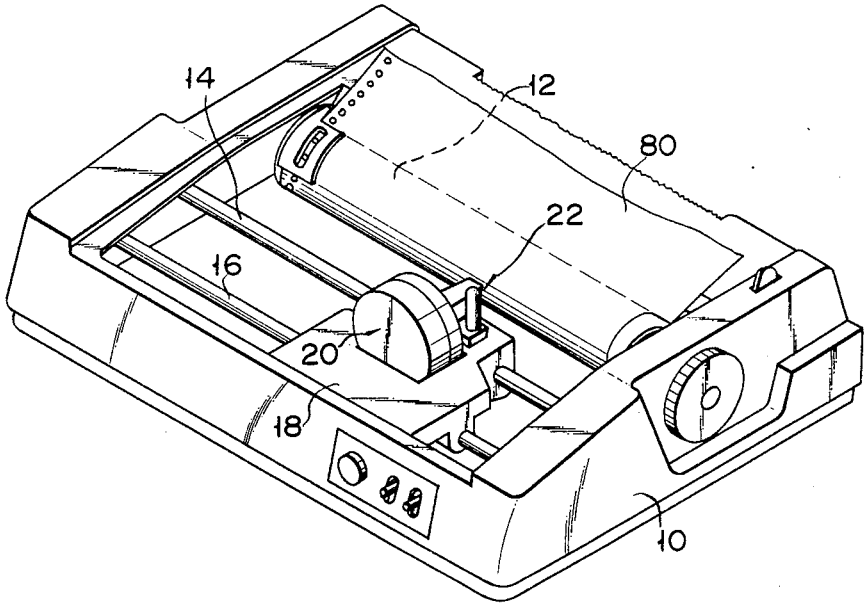
FIG. 1 is a perspective view roughly showing the whole of a first embodiment of the ink dot printer according to the present invention.

FIG. 1 roughly shows the whole of a first embodiment of the ink dot printer according to the present invention. A platen 12 is arranged in a housing 10 of the ink dot printer, horizontally extending along its rotary center line, and a carrier shaft 14 and a guide shaft 16 are arranged therein parallel to the rotary center line. A carriage 18 is mounted on the carrier and guide shafts 14 and 16 to reciprocate along these shafts. The carriage 18 is reciprocated by well-known carriage moving means (not shown). An ink film forming means 22 and a printing head 20 are mounted on the carriage 18.

Figure 2:
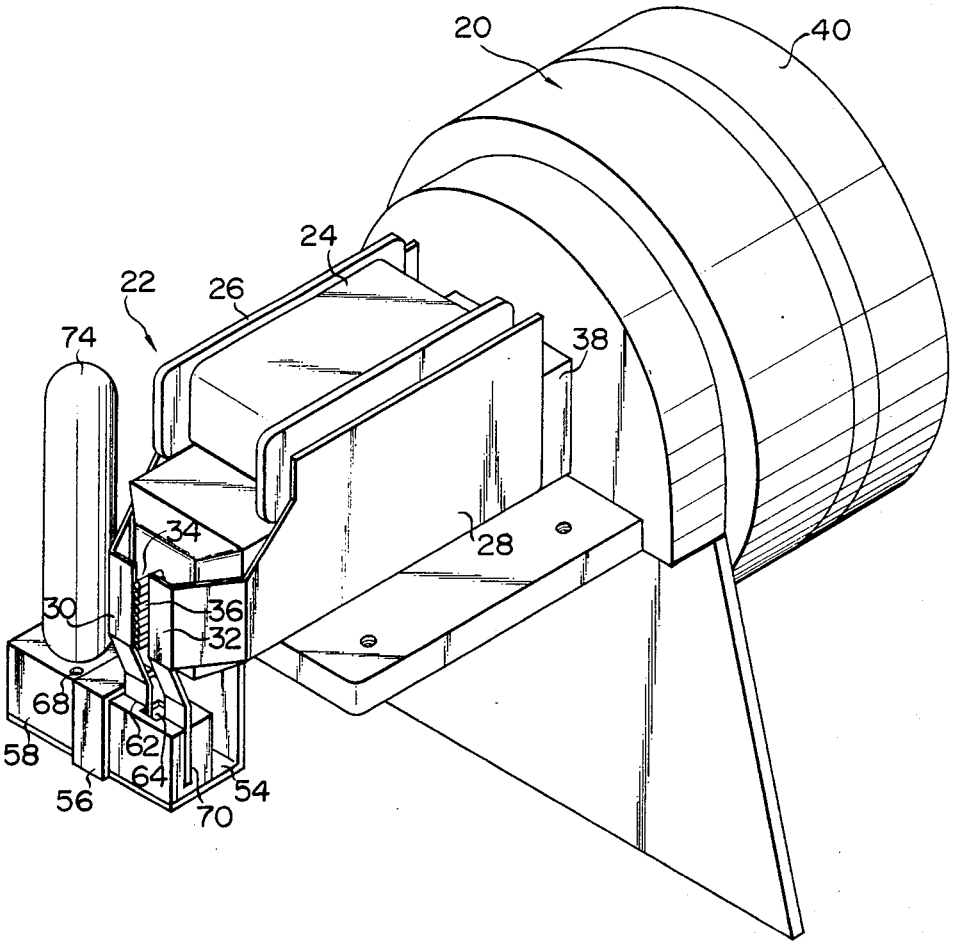
FIG. 2 is an enlarged perspective view roughly showing the whole of a printing head and an ink film forming means shown in FIG. 1.
Figure 3:
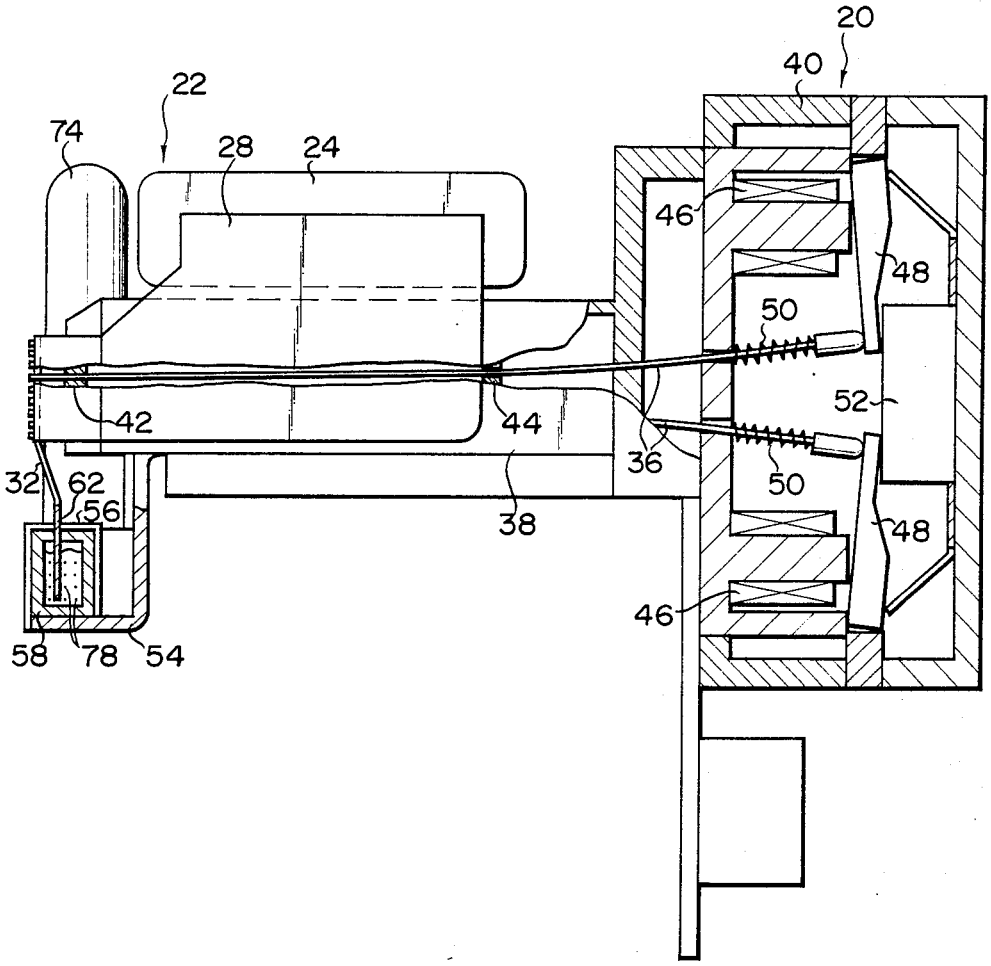
FIG. 3 is a side view roughly showing the printing head and ink film forming means in FIG. 2 partly in section.
Figure 4:
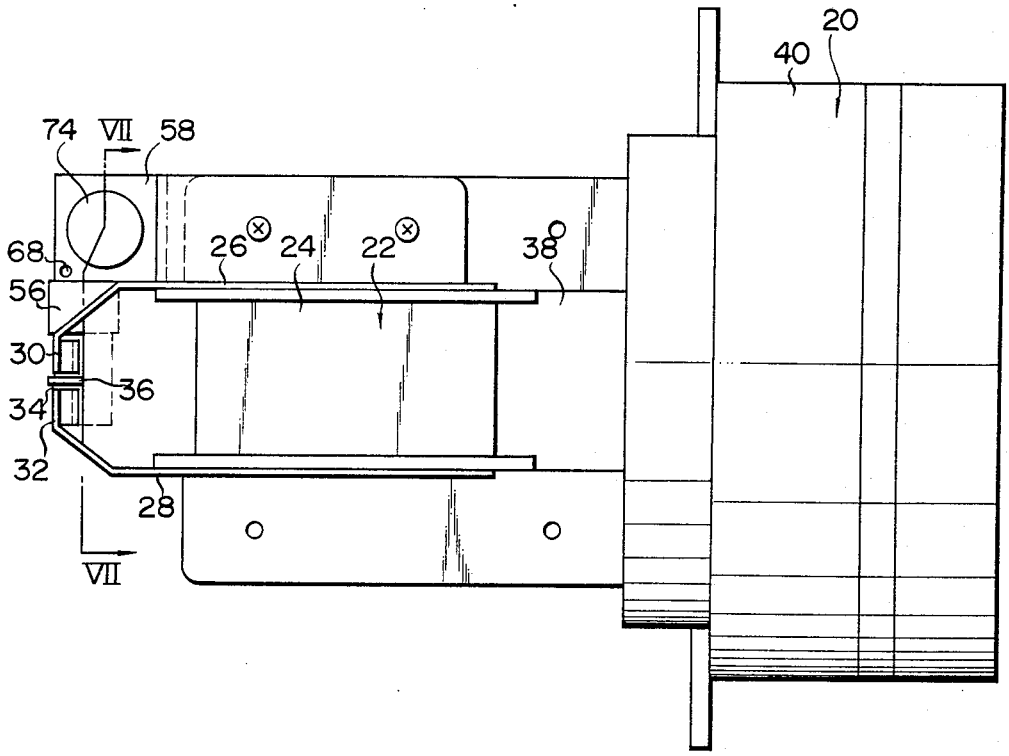
FIG. 4 is a plane view roughly showing the printing head and ink film forming means in FIG. 2.

As shown in FIGS. 2 through 4, the ink film forming means 22 has an electromagnet 24 which serves as a means for generating magnetic force, and a pair of magnetic pole plates 26 and 28 are arranged on both sides of the electromagnet 24 to oppose each other. Front end portions 30 and 32 of the paired magnetic pole plates 26 and 28 form a slit 34, which extends substantailly in the vertical direction, as shown in FIGS. 2 and 3.

One end portion of each of plural needles 36 is arranged adjacent to one another along the longitudinal direction of the slit 34 and extends in the slit 34 between the paired magnetic pole plates, as shown in FIGS. 2 through 4. The other end portions of the plural needles 36 extend through a frame 38 located between the paired magnetic pole plates 26 and 28, as shown in FIGS. 2 through 4, and enter into a cover 40 for a printing head 20, as shown in FIG. 3. The needles 36 are held relative to one another and freely supported to be reciprocatable in their longitudinal direction by needle guides 42 and 44 arranged in the frame 38, as shown in FIG. 3. The position of the needles 36, in this state, is called the first position.

Plural electromagnets 46 which serve as a means for driving the plural needles 36 are arranged, relative to the plural needles, in the cover for the printing head 20, and armatures 48 are arranged adjacent to the electromagnets 46. Each of the needles 36 is urged to its first position, as shown in FIGS. 2 through 4, by a return spring 50 wound around it, and the end face of its other end is in contact with the armature 48, as shown in FIG. 3, to separate the armature 48 from the electromagnet 46 while it contacts a stopper 52.

In the case of this ink dot printer, an ink tank supporting base 54 is attached to the frame 38, as shown in FIGS. 2 and 3, extending horizontally just under the front end portions 30 and 32 of the paired magnetic pole plates 26 and 28. Namely, the ink tank supporting base 54 extends in a direction perpendicular to the longitudinal direction of the slit 34. A guide member 56 is attached to the ink tank supporting base 54 on one side of the slit 34. An ink tank 58, which serves as the magnetic ink storing means, is mounted on the ink tank supporting base 54 and guided by the guide member 56 to freely move horizontally, or in a direction perpendicular to the longitudinal direction of the slit 34.

Figure 5:
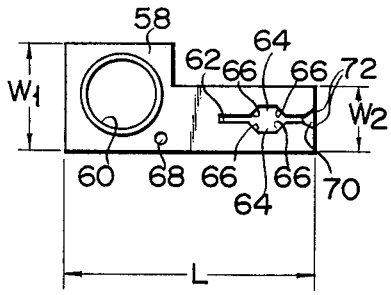
FIG. 5 is a plane view showing only an ink tank in FIG. 2.

The ink tank 58 is substantially L-shaped when viewed from its top. A magnetic ink supplying hole 60 is formed on the top surface of the ink tank 58 at the left end portion thereof, and an elongated slot 62, into which the front end portions 30 and 32 of the paired magnetic pole plates 26 and 28 are inserted, is also formed on the top surface of the ink tank 58 at the right end portion thereof. The center of the elongated slot 62 is shaped to form an enlarged opening 64 which corresponds to the slit 34 between the paired magnetic pole plates 26 and 28. The boundary between the slot 62 and the enlarged opening 64 is tapered, as shown in FIG. 5. An air opening 68 is also formed on the top surface of the ink tank 58. This air opening 68 is spaced apart enough from the side wall of the ink tank 58 and the elongated slot 62 so as not to be effected by the rising of a magnetic ink to be stored in the magnetic tank 58, caused by the surface tension of the magnetic ink in the region of the side wall and the front end portions 30 and 32 of the paired pole plates 26 and 28 when inserted in the elongated slot 62. This independent air opening 68, however, is not necessary, and the enlarged opening 64 of the slot 62, which is relatively large, may serve as the air opening for the ink tank 58.

Dimension $W_1$ of the left end portion of the ink tank 58 when measured in the vertical direction in FIG. 5, or in the direction in which the needles extend, is set larger than dimension $W_2$ of the right end portion thereof, and dimension L of the ink tank 58 when measured in the horizontal direction in FIG. 5, or in a direction perpendicular to the longitudinal direction of the slit 34, is larger than each one of dimensions $W_1$ and $W_2$. The elongated slot 62 extends in the direction of dimension L, that is, in the longitudinal direction of the ink tank 58.

Figure 6:
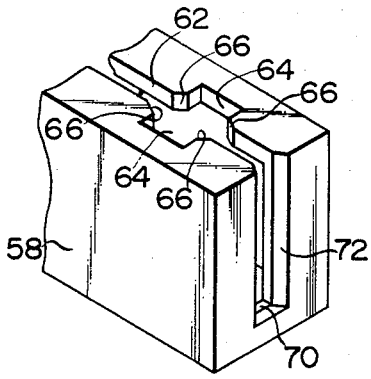
FIG. 6 is a perspective view showing the right end portion of the ink tank in FIG. 5, enlarged.

A guide hole 70 is formed on the right end face of the ink tank 58, as shown in FIGS. 5 and 6, extending in the vertical direction, or in the longitudinal direction of the slit 34 between the paired magnetic pole plates 26 and 28, and is tapered at that area 72 thereof which is adjacent to the right end face of the ink tank 58.

As shown in FIGS. 2 and 3, the front end portions 30 and 32 of the paired magnetic pole plates 26 and 28 are inserted into the elongated slot 62 and guide hole 70 of the ink tank 58, and leakage of the magnetic ink from the ink tank 58 through the guide hole 70 thereof is prevented by well known sealing means (not shown) which is in close contact with the front end portion 32 of the magnetic pole plate 28.

Figure 7:
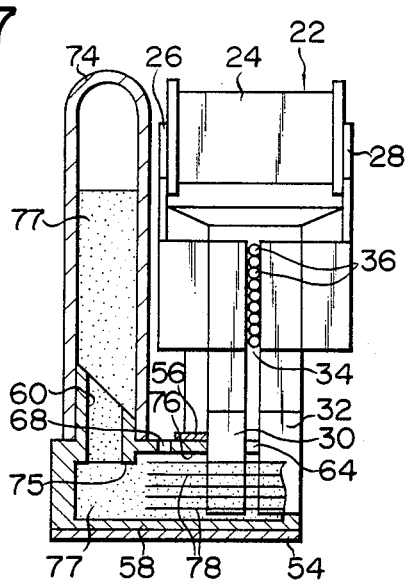
FIG. 7 is a sectional view taken along the line VII—VII in FIG. 4.

As shown particularly in FIG. 7, an ink cartridge 74 is detachably mounted to the magnetic ink supplying hole 60 of the ink tank 58. The inner end face 75 of the magnetic ink supplying hole 60 is located lower in the ink tank 58 than the inner end face 76 of the air opening 68, or the inner surface of the top wall of the ink tank 58. The surface of the magnetic ink, supplied from the ink cartridge 74 into the ink tank 58 through the magnetic ink supplying hole 60, is kept at a lower level in the ink tank 58 than the inner end face 76 of the air opening 68.

A plurality of fiber-like lines 78 are housed in the ink tank 58, as shown in FIGS. 3 and 7. These lines 78 extend in the horizontal direction in FIG. 7, or in the longitudinal direction of the ink tank 58, and are slightly separated from one another in the vertical direction in FIG. 7. However, they are not located just under the magnetic ink supplying hole 60 of the ink tank 58. They may be made of horse, racoon or dog hairs, or filaments of synthetic resin having a diameter of $100\mu$–$50\mu$.

A recording paper 80 is mounted on the platen 12 inside the housing 10 shown in FIG. 1.

Figure 8:
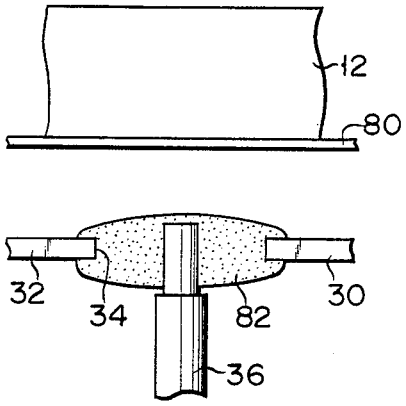
FIG. 8 is a plane view showing, in enlarged scale, a condition under which magnetic ink film is formed in the slit between the paired magnetic pole plates, and under which a needle is located at the first position.

When a main switch (not shown) arranged on the housing 10 is turned ON, current is supplied to the electromagnet 24, so that the magnetic ink in the ink tank 58 is drawn into the slit 34 between the front end portions 30 and 32 of the paired magnetic pole plates 26 and 28, due to the effect of the magnetic field produced in the slit 34 by magnetic flux generated between the paired magnetic pole plates 26 and 28, thereby forming a magnetic ink film 82 in the slit 34, as shown in FIG. 8. The magnetic ink film 82 in the slit 34 immerses the one end portion of each of the needles 36, which are located at the first position as shown in FIGS. 2 through 4.

Figure 9:
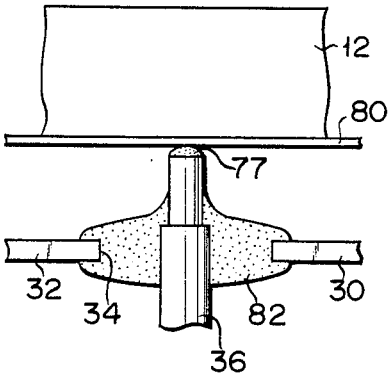
FIG. 9 is a plane view showing a condition under which the needle in FIG. 8 is located at the second position.
Figure 10:
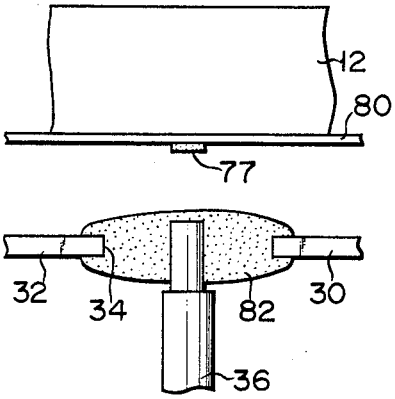
FIG. 10 is a plane view showing a condition under which the needle in FIG. 9 is returned to the first position after forming a dot of the magnetic ink on a recording paper on a platen.

When a key on the keyboard (not shown) is pushed, current is supplied to that electromagnet 46 which corresponds to the key, and the electromagnet 46 draws its corresponding armature 48 against the action of the return spring 50 wound around the needle 36. The needle 36 which corresponds to the armature 48 drawn by the electromagnet 46 projects from the magnetic ink film 82 in the slit 34 toward the recording paper 80, as shown in FIG. 9, slightly touches the recording paper 80 on the platen 12, and forces the magnetic ink 77 on its one end face onto the recording paper 80. The position of the needle 36 in this state is regarded as its second position. The magnetic ink 77 stuck on the recording paper 80 by the needle 36 when at the second position, as shown in FIG. 9, continues to adhere to the recording paper 80 to form a dot of the magnetic ink 77 even after the needle 36 is returned to the first position by the action of the return spring 50, as shown in FIG. 10.

When the carriage 18 is moved along the carrier and guide shafts 14 and 16 to form a plurality of dots on the recording paper 80 along the longitudinal center line of the platen 12, the magnetic ink 77 swells because of inertial force in the ink tank 58, caused when the carriage 18 starts and stops its movement, and a sudden repeat of this movement causes the swelling of the magnetic ink 77 to become more pronounced. In the case of this example, however, the plural thin lines 78 arranged inside the ink tank 58 function as wave eliminating means, thereby preventing the swelling of the magnetic ink 77 in the ink tank 58 from becoming more pronounced. Further, the inner end face 75 of the magnetic ink supplying hole 60 is set lower in level in the ink tank 58 than the inner end face 76 of the air opening 68, and a space is created in the ink tank 58 between the surface of the magnetic ink 77 and the inner end face 76 of the air opening 68, as shown in FIG. 7. Therefore, the magnetic ink 77 in the ink tank 58 will not jet outside through the air opening 68 and enlarged opening 64 of the slot 62, even when the magnetic ink 77 swells more or less in the ink tank 58. Furthermore, the thin lines 78 can achieve high effect particularly as the wave eliminating means, since they extend in the longitudinal direction of the ink tank 58, or in the direction in which the carriage 18 is moved. The present wave eliminating means and the position of the inner end face 75 of the magnetic ink supplying hole 60 in the ink tank 58 are extremely effective in preventing the swelling of the magnetic ink 77 in the ink tank 58, which is caused even when the ink dot printer is being moved, and are also effective in preventing the jetting of the magnetic ink 77 through the air opening 68 and enlarged opening 64 of the slot 62, which is caused by such swelling of the magnetic ink 77. In addition, the level and amount of magnetic ink 77 drawn from the ink tank 58 to the slit 34 does not change, because the surface of the magnetic ink 77 does not swell but is kept at a certain level in the ink tank 58. Therefore, the amount of magnetic ink 77 adhered on those one end portions of the needles 36 which are immersed in the magnetic ink film 82 in the slit 34, is kept constant to form dots with a certain density.

Moreover, the supply of magnetic ink 77 into the ink tank 58 can be achieved again by replacing the ink cartridge 74 with a new one when the ink cartridge 74 becomes empty and the old supply of magnetic ink 77 can no longer be supplied to the ink tank 58. Attached to the ink cartridge 74 is a well-known cap which is pierced and broken when the ink cartridge 74 is set in the magnetic ink supplying hole 60 of the ink tank 58.

When the main switch (not shown) is turned OFF after the ink dot printer has finished the printing process, current supplied to the electromagnet 24 is stopped and the magnetic flux between the paired magnetic pole plates 26 and 28 vanishes. As a result, the magnetic ink 77 which has formed the magnetic ink film 82 in the slit 34 is collected into the ink tank 58 due to its weight and the capillary action of the thin lines 78 in the ink tank 58.

Figure 11:
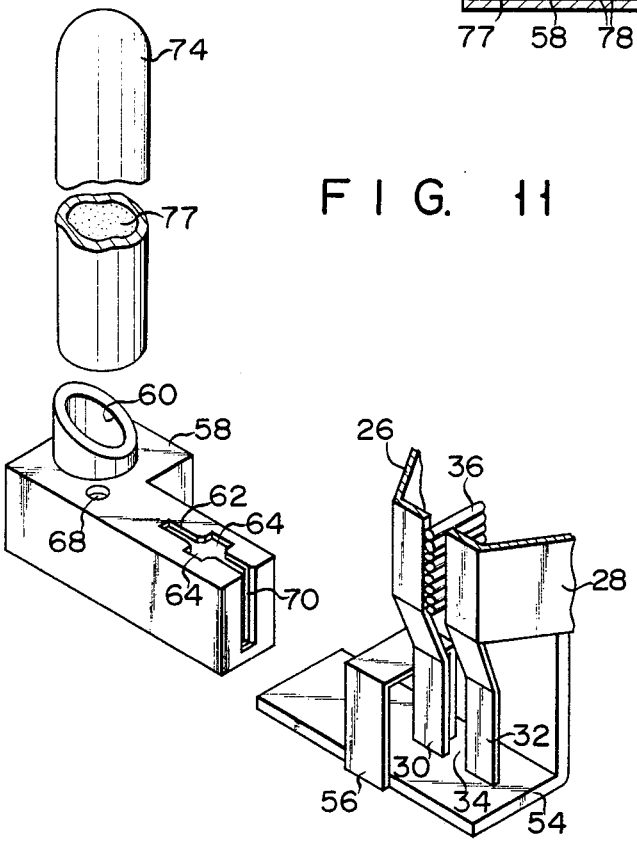
FIG. 11 is a perspective view showing the connection between the ink tank and the front end portions of the paired magnetic pole plates released.

When the ink dot printer is left unused for a long time, causing the magnetic ink 77 to dry and stick to the inner wall of the ink tank 58, and the ink tank 58 has to be cleaned accordingly, the connection between the ink tank 58 and the front end portions 30 and 32 of the paired magnetic pole plates 26 and 28 can be released, as shown in FIG. 11, by only moving the ink tank 58 in left direction in FIG. 2, thereby enabling the ink tank 58 to be easily detached from the ink dot printer.

When the ink tank 58 is mounted on the ink tank supporting base 54 and moved along the guide member 56 in the right direction in FIG. 11 after cleaning of the ink tank 58, the front end portions 30 and 32 of the paired magnetic pole plates 26 and 28 are guided into the elongated slot 62 of the ink tank 58 through the guide hole 70. At this time, one of the front end portions 30 strikes the dead end of the slot 62 to thereby stop the ink tank 58. The enlarged opening 64 of the slot 62 corresponds, in this state, to the slit 34 between the paired magnetic pole plates 26 and 28, as shown in FIG. 2. The guide hole 70 is closed by the other front end portion 32, and the leakage of the magnetic ink 77 through the guide hole 70 can be prevented by the combination of the front end portion 32 and well-known sealing means, as described above. Since the boundary 66 between the slot 62 and its enlarged opening 64 and that area 72 of the guide hole 70 adjacent to the right end face of the ink tank 58 are tapered, the front end portions 30 and 32 of the paired magnetic pole plates 26 and 28 can be easily fitted into and detached from the guide hole 70 and the slot 62.

A second embodiment of the ink dot printer according to the present invention will be described referring to FIGS. 12 through 14. The same parts as those in the first embodiment described in reference to FIGS. 1 through 11 will be represented by the same reference numerals, and the description of these parts will be omitted.

Figure 12:
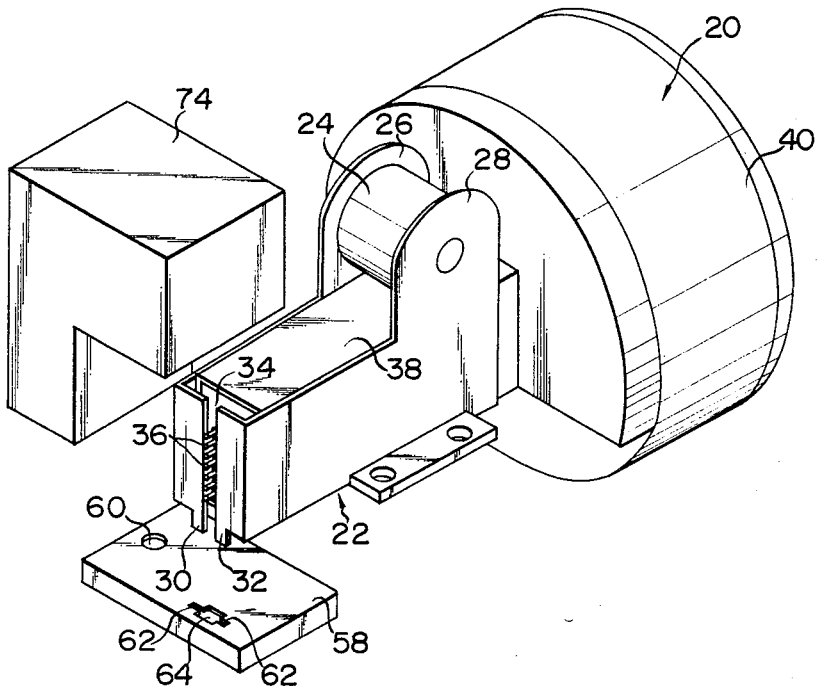
FIG. 12 is a perspective view roughly showing, in enlarged scale, the whole of a printing head and an ink film forming means in a second embodiment of the ink dot printer according to the present invention, and also showing connections between the ink tank and the front end portions of the paired magnetic pole plates and between the ink tank and an ink cartridge released.

As shown in FIG. 12, the ink tank 58 is made flatter, and neither the independent air opening 68 nor the guide hole 70, which is to be continuous to the slot 62 and into which the front end portions 30 and 32 of the paired magnetic pole plates 26 and 28 are to be fitted, is provided. The enlarged opening 64 of the slot 62 serves as the air opening for the ink tank 58 in this case. The connection between the front end portions 30 and 32 of the paired magnetic pole plates 26 and 28 and the ink tank 58 can be attained in such a way that the ink tank 58 is moved along the longitudinal direction of the slit 34. This allows the front end portions 30 and 32 of the paired magnetic pole plates 26 and 28 to be fitted into the slot 62 of the ink tank 58, as shown in FIG. 13.

Figure 13:
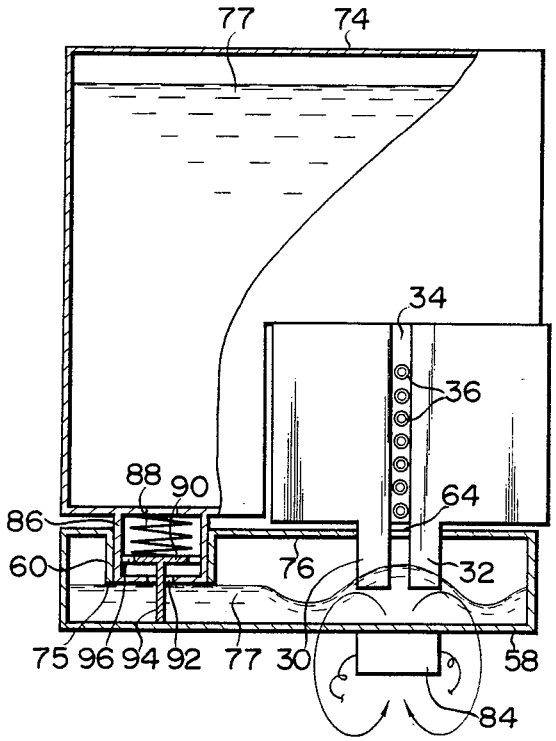
FIG. 13 is a front view roughly showing, partly cut off, the ink tank in FIG. 12 connected with the front end portions of the paired magnetic pole plates and with the ink cartridge.
Figure 14:
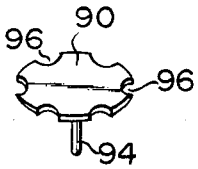
FIG. 14 is a perspective view showing only a plug for the ink cartridge in FIG. 13.

An electromagnet 84 is fixed to the outer surface of the bottom wall of the ink tank 58 to face the slit 34 in the longitudinal direction of the slit 34 between the paired magnetic pole plates 26 and 28, as shown in FIG. 13.

As shown in FIG. 13, a sleeve 86 which is detachably fitted into the magnetic ink supplying hole 60 of the ink tank 58 is formed on the underside of the ink cartridge 74, and a spring 88 and a plate-like plug 90 urged downward by the spring 88 are housed in the sleeve 86. The plug 90 has a push rod 94 which extends downward to project outside through a discharge opening 92 formed on the bottom end face of the sleeve 86, and a plurality of cut-away portions 96 are formed on the outer circumference of the plug 90, as shown in particular detail in FIG. 14. The radius of a circle, formed by connecting inner ends of these cutaway portions 96 when viewed radially, is set larger than that of the discharge opening 92.

When the sleeve 86 is fitted into the magnetic ink supplying hole 60 of the ink tank 58, the push rod 94 strikes the inner surface of the bottom wall of the ink tank 58 to separate the plug 90 from the discharge opening 92 against the spring 88, thereby allowing the magnetic ink 77 in the ink cartridge 74 to flow into the ink tank 58 through the cutaway portions 96 of the plug 90 and the discharge opening 92 of the sleeve 86. The flow of the magnetic ink 77 into the ink tank 58 is stopped when the surface of the magnetic ink 77 in the ink tank 58 reaches the discharge opening 92 of the sleeve 86, or when it reaches the inner end face 75 of the magnetic ink supplying hole 60, as shown in FIG. 13. Thereafter, the surface of the magnetic ink 77 in the ink tank 58 is kept at the same level as the discharge opening 92 of the sleeve 86 of the ink cartridge 74 until the ink cartridge 74 is emptied. The front end portions 30 and 32 of the paired magnetic pole plates 26 and 28 which have been inserted into the slot 62 of the ink tank 58 are immersed this time in the magnetic ink 77 in the ink tank 58, as shown in FIG. 13. This time, a space, which serves as the air opening, is also created between the surface of the magnetic ink 77 and the inner end face 76 of the enlarged opening 64 of the ink tank 58, that is, the inner surface of the top wall of the ink tank 58.

When the main switch (not shown) is turned OFF after the ink dot printer has finished the printing process, current supply to the electromagnet 24 is stopped and the magnetic flux between the paired magnetic pole plates 26 and 28 vanishes. As a result, the magnetic ink 77 which has formed the film 82 in the slit 34, as shown in FIG. 8, is collected, due to its weight, into the ink tank 58 through the enlarged opening 64. In the case of this second embodiment, however, current is supplied to the electromagnet 84 of the ink tank 58 as soon as the main switch (not shown) is turned OFF, and the magnetic ink 77 which has formed the film 82 in the slit 34 is therefore forcedly drawn into the ink tank 58 owing to magnetic force generated by the electromagnet 84 of the ink tank 58. Even when the viscosity of the magnetic ink 77 which forms the film 82 in the slit 34 increases because it has been exposed to air for a relatively long time, it is not left to remain in the slit 34 regardless of its surface tension.

The ink cartridge 74 can be detached from the magnetic ink supplying hole 60 of the ink tank 58 even when the magnetic ink 77 is still left in the ink cartridge 74. This is because the push rod 94 of the plug 90 is separated from the inner surface of the bottom wall of the ink tank 58 when the sleeve 86 of the ink cartridge 74 is separated from the magnetic ink supplying hole 60 of the ink tank 58, and because the plug 90 is pressed onto the bottom wall of the sleeve 86 by the spring 88 to close the discharge opening 92 thus preventing the magnetic ink 77 from being scattered outside the ink cartridge 74.

Also in the case of the second embodiment, the ink tank 58 may be provided with the guide hole 70 which guides the front end portions 30 and 32 of the paired magnetic pole plates 26 and 28 into the slot 62 in a direction perpendicular to the longitudinal direction of the slit 34, and the wave eliminating means which comprises a plurality of the fiber-like thin lines 78, for example, may be arranged in the ink tank 58.

It should be understood that the present invention is not limited to the above-described embodiments, and that various modifications and improvements may be made without departing from the spirit and scope of the present invention.

Figure 15:
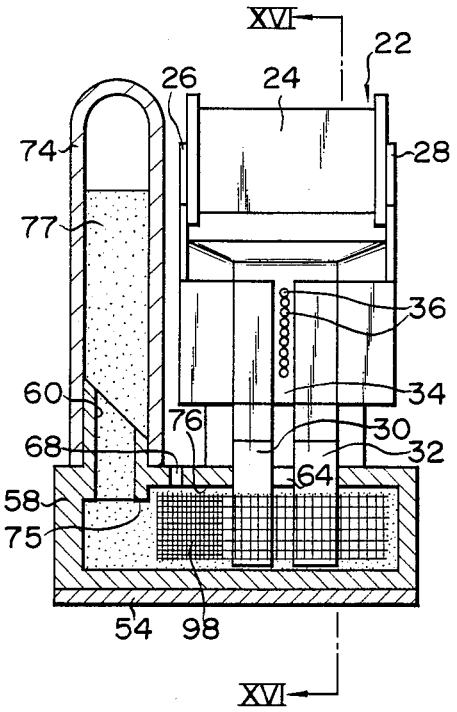
FIG. 15 is a sectional view, similar to FIG. 7, showing a variation of the wave eliminating means arranged inside the ink tank in FIG. 7.
Figure 16:
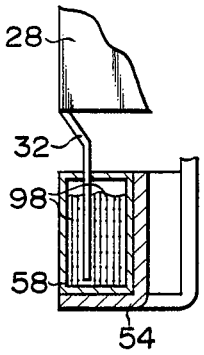
FIG. 16 is a sectional view taken along the line XVI—XVI in FIG. 15.
Figure 17:
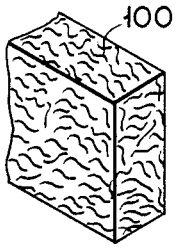
FIGS. 17 and 18 are perspective views showing other variations of the wave eliminating means.
Figure 18:
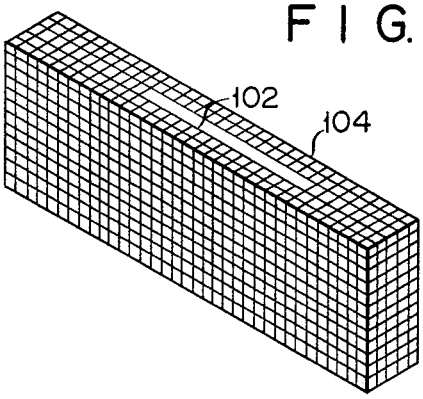

As the wave eliminating means which prevents the magnetic ink 77 from swelling in the ink tank 58, a sponge, for example, may be used instead of the plural fiber-like thin lines 78. Or nets 98 may be arranged, adjacent to one another in the longitudinal direction of the needles 36, in the ink tank 58, as shown in FIGS. 15 and 16. Or a mass 100 formed by entangling fiber-like short thin lines with one another, as shown in FIG. 17, may be used. Or a basket 104 provided with a slot 102 into which the front end portions 30 and 32 of the paired magnetic pole plates 26 and 28 are to be fitted, as shown in FIG. 18, may be used.

The net 98 is less dense in the area adjacent to the slit 34 between the front end portions 30 and 32 of the paired magnetic pole plates 26, 28 than in its other area. When constructed like this, the magnetic ink 77 which has formed the film 82 in the slit 34 can be quickly collected into the ink tank 58 through the enlarged opening 64 by ceasing the magnetic flux between the paired magnetic pole plates 26 and 28, even in the case where the wave eliminating means is arranged in the ink tank 58. The nets 98 are not located just under the magnetic ink supplying hole 60 for the purpose of allowing the magnetic ink 77 to be quickly supplied from the ink cartridge 74 to the ink tank 58 through the magnetic ink supplying hole 60.

Figure 19:
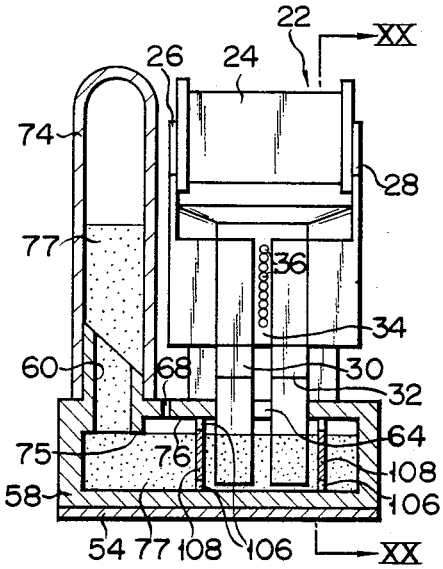
FIG. 19 is a sectional view, similar to FIG. 7, roughly showing a further variation of the wave eliminating means arranged inside the ink tank in FIG. 7.
Figure 20:
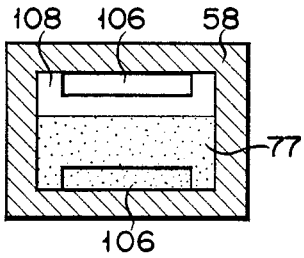
FIG. 20 is a sectional view taken along the line XX—XX in FIG. 19.
Figure 21:
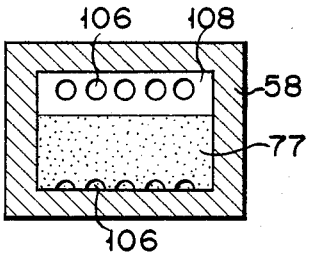
FIG. 21 is a sectional view, similar to FIG. 20, showing a variation of the wave eliminating means in FIG. 20.

As the wave eliminating means, which prevents the magnetic ink 77 from swelling in the ink tank 58, partition plates 108 each having through-holes 106, for example, may be arranged in the ink tank 58, extending in a direction perpendicular to the longitudinal direction of the ink tank 58, as shown in FIGS. 19 and 20. The through-hole 106 has no limitation in shape and may be made to have an easily-processed shape. Namely, holes 106 may be made circular, for example, as shown in FIG. 21.

The electromagnet 84 arranged just under the slit 34 and on the outer surface of the bottom wall of the ink tank 58, for forcibly collecting the magnetic ink 77 forming the film 88 in the slit 34 from the slit 34 into the ink tank 58, may be used in the first embodiment shown in FIGS. 1 to 11 and in the various modifications shown in FIGS. 15 to 21.

What is claimed is:

1. An ink dot printer, comprising:

elongate magnetic ink storing means having a magnetic ink supplying hole and an air opening;

a pair of magnetic pole plates arranged opposite to each other to form a slit one end of which is arranged to be immersed in magnetic ink stored in the magnetic ink storing means;

magnetism generating means for selectively magnetizing the pair of the magnetic pole plates to introduce the magnetic ink stored in the magnetic ink storing means into the slit to form a magnetic ink film in the slit;

a plurality of needles arranged adjacent to one another along the longitudinal direction of the slit and each freely movable in its longitudinal direction between a first position where one end portion of each needle is immersed in the magnetic ink film in the slit formed by said pair of magnetic pole plates, and a second position where said one end portion is projected from the magnetic ink film;

driving means for selectively driving the needles to move them from the first position to the second position, wherein the selected needles force the magnetic ink as adhered on said one end portions at the first position, onto a recording paper to form dots of the magnetic ink on the paper so that characters can be printed by grouping of the dots;

an ink cartridge arranged to be detachably mounted on the magnetic ink storing means to communicate magnetic ink contained in the cartridge into said magnetic ink supplying hole; and a magnet associated with the magnetic ink storing means, said magnet being in operative relation to a bottom end of the slit formed by said pair of magnetic pole plates and at a position along the longitudinal direction of the slit, for returning magnetic ink remaining in the slit to the magnetic ink storing means when the magnetism generating means ceases to magnetize said pair of magnetic pole plates.

2. An ink dot printer according to claim 1, wherein the ink cartridge is located outside of the direction in which the needles are moved between the first and the second position.

3. An ink dot printer according to claim 1, wherein the inner end face of the magnetic ink supplying hole is set lower in the magnetic ink storing means than the inner end face of the air opening.

4. An ink dot printer according to claim 3, wherein the ink cartridge is located outside of the direction in which the needles are moved between the first and the second position.

5. An ink dot printer according to claim 1, wherein the magnet is an electromagnet.

6. An ink dot printer according to claim 1, wherein the magnetic ink storing means includes wave eliminating means for preventing the magnetic ink from swelling in the magnetic ink storing means.

7. An ink dot printer according to claim 6, wherein the wave eliminating means comprises a plurality of thin fibers housed inside the magnetic ink storing means.

8. An ink dot printer according to claim 7, wherein the wave eliminating means is outside the region just under the magnetic ink supplying hole.

9. An ink dot printer according to claim 6, wherein the wave eliminating means comprises at least one net housed inside the magnetic ink storing means.

10. An ink dot printer according to claim 9, wherein the wave eliminating means is outside the region just under the magnetic ink supplying hole.

11. An ink dot printer according to claim 9, wherein the net is less dense in mesh in the area adjacent to the slit formed by said pair of magnetic pole plates than in its other area.

12. An ink dot printer according to claim 9, wherein the wave eliminating means is a basket made of nets.

13. An ink dot printer according to claim 6, wherein the wave eliminating means comprises at least one partition plate having a through-hole and housed inside the magnetic ink storing means, extending in a direction perpendicular to the longitudinal direction of the magnetic ink storing means.

14. An ink dot printer according to claim 6, wherein the ink cartridge is located outside of the direction in which the needles are moved between the first and the second position.

15. An ink dot printer according to claim 6, wherein the inner end face of the magnetic ink supplying hole is set lower in the magnetic ink storing means than the inner end face of the air opening.

16. An ink dot printer according to claim 1, wherein the magnetic ink storing means has a guide hole into which the pair of magnetic pole plates are freely detachably fitted in a direction perpendicular to the longitudinal direction of the slit formed by the magnetic pole plates and which allows the magnetic ink storing means to be located at a predetermined position in relation to the magnetic pole plates.

17. An ink dot printer according to claim 16, wherein the ink cartridge is located outside of the direction in which the needles are moved between the first and the second position.

18. An ink dot printer according to claim 16, wherein the inner end face of the magnetic ink supplying hole is set lower in the magnetic ink storing means than the inner end face of the air opening.

19. An ink dot printer according to claim 16, wherein the magnetic ink storing means includes wave eliminating means which serves to prevent the magnetic ink from swelling in the magnetic ink storing means.

20. An ink dot printer according to claim 1, wherein the magnetic ink storing means comprises an ink tank having an elongate slot through which said pair of magnetic pole plates are insertable for immersion in magnetic ink stored in the ink tank, and the slot has an enlarged portion which faces the slit formed by said magnetic pole plates, and the dimension of the enlarged portion in a direction perpendicular to the length of the slot is larger than the width of the slot.

21. An ink dot printer according to claim 6, wherein the magnetic ink storing means comprises an ink tank having an elongate slot through which said pair of magnetic pole plates are insertable for immersion in magnetic ink stored in the ink tank, and the slot has an enlarged portion which faces the slit formed by said magnetic pole plates, and the dimension of the enlarged portion in a direction perpendicular to the length of the slot is larger than the width of the slot.

22. An ink dot printer according to claim 16, wherein the magnetic ink storing means comprises an ink tank having an elongate slot through which said pair of magnetic pole plates are insertable for immersion in magnetic ink stored in the ink tank, and the slot has an enlarged portion which faces the slit formed by said magnetic pole plates, and the dimension of the enlarged portion in a direction perpendicular to the length of the slot is larger than the width of the slot.

* * * * *